United States Patent [19]

Maloney

[11] Patent Number: 4,631,905

[45] Date of Patent: Dec. 30, 1986

[54] BAG MAKING APPARATUS

[75] Inventor: John Maloney, Stoke-on-Trent, England

[73] Assignee: Johnsen, Jorgensen, Jaypak, Ltd., London, England

[21] Appl. No.: 744,859

[22] Filed: Jun. 14, 1985

Related U.S. Application Data

[63] Continuation of Ser. No. 444,899, Nov. 18, 1981, Pat. No. 4,540,089, and a continuation of Ser. No. 541,829, Oct. 14, 1983, Pat. No. 4,557,377.

[30] Foreign Application Priority Data

Oct. 16, 1982 [GB] United Kingdom ..... 8229625
Jan. 18, 1983 [GB] United Kingdom ..... 8301279

[51] Int. Cl.[4] ..... B31B 41/00; B65B 29/10

[52] U.S. Cl. ..... 53/554; 53/158; 53/239; 53/555; 493/196; 493/931

[58] Field of Search ..... 53/239, 158, 553, 550, 53/474, 237, 554, 555; 493/197-193, 931

[56] References Cited

U.S. PATENT DOCUMENTS

| | | | |
|---|---|---|---|
| 2,423,187 | 7/1947 | Haugh | 493/197 |
| 2,718,105 | 9/1955 | Ferguson et al. | 493/197 X |
| 2,925,719 | 2/1960 | Robbins et al. | 53/239 X |
| 3,133,480 | 5/1964 | Gerard | 493/197 |
| 3,390,507 | 7/1968 | Repko | 493/197 X |
| 3,540,183 | 11/1970 | Bodolay et al. | 493/931 X |
| 3,892,060 | 7/1975 | Stanley, Jr. | 53/239 |

*Primary Examiner*—James F. Coan
*Attorney, Agent, or Firm*—Neil F. Markva

[57] ABSTRACT

The bag making apparatus may have a bonding means for making bonded seams between webs of thermoplastic material. The bonding means includes first, second, and optionally third, sets of cooperating rotary or reciprocating, bonding members for making transverse and longitudinal seams. The apparatus includes seaming interrupting means which cooperates with one of the bonding means. The bonding means and interrupting means are arranged to cooperate together to form bags from the webs of thermoplastic material so that each bag has a sealed or sealable compartment for containing or containing a material for mixing, a pocket for measuring, and having a mouth opening between the interrupted seams, and a frangible barrier between the compartment and the pocket.

14 Claims, 16 Drawing Figures

BAG MAKING APPARATUS

This is a continuation of applications Ser. No. 444,899 filed Nov. 18, 1981, now U.S. Pat. No. 4,540,089, and Ser. No. 541,829 filed Oct. 14, 1983, now U.S. Pat. No. 4,557,377.

This invention relates to apparatus for use in making bags which comprise a sealed compartment made of relatively robust film material and a pocket made of relatively frangible film material secured in position within the compartment and provided with an open mouth leading only into the pocket. Such a bag is useful, for example, for packaging materials which are to be mixed with a liquid to form a mixture. Many such materials are known, e.g. dry mortar in pulverulent form, plaster powder, and food or beverage making mixture such as a cake mixture, and such material is hereinafter referred to as "a material for mixing".

SUMMARY OF THE INVENTION

According to one aspect of the present invention there is provided apparatus for use in making bags which comprise a sealed compartment made of relatively robust film material and a pocket made of relatively frangible film material secured in position within the compartment and having an open mouth leading only into the pocket. The apparatus comprises feeding means and bonding means with the feeding means being arranged to feed a plurality of webs of the film material including both robust and frangible material along a transit path through the bonding means which comprise confronting bonding members disposed at opposite sides of the web transit path. The bonding members are arranged to form bonded seams between the webs of film material to form the bags. Bond interrupting means is provided in the web transit path between at least portions of two of the confronting members of the bonding means to prevent bonds being made to those surfaces of the webs of frangible material which abut the bond interrupting means so as to form the mouth of the pocket while allowing bonds to be made to the other surfaces of the webs at each side of the bond interrupting means to complete the bag.

The bag is preferably formed so that the walls of said pocket are formed from a single web of the frangible material disposed between opposed outer walls of the bag which are made of the relatively robust material. The single web of the frangible material is preferably of a material which is thinner than the material from which the outer walls are formed. This form of bag has given highly satisfactory results under test conditions and is very convenient to manufacture upon the apparatus of the invention.

For making the aforementioned preferred bags the apparatus is preferably adapted so as:

(a) to unroll two sheets of relatively robust plastics film and to unroll a lay-flat tube of a relative frangible plastics film;

(b) to feed said films to slitting means so that the tube is sandwiched centrally between the sheets and so that the sandwich of sheet and tube is slit longitudinally to form two separate runs in each of which one half of the tube constitutes an intermediate film which is folded to give two abutting intermediate webs disposed between two outer webs of the sheet film;

(c) to separate portions of said abutting intermediate webs by means of bond interrupting means and to form a predetermined seam between each said portion and an abutting portion of the adjacent web of relatively robust sheet film, for forming the mouths of the bags; and (d) to form further seams between said webs to form bags having open ends defined between confronting portions of said webs of relatively robust film, for use as material insertion openings for admitting contents into compartments in the bags prior to the closure of said open ends to close said compartments.

Said further seams are preferably formed so that each bag is made in two stages, at least some of the seams lying, in the direction of movement of the webs, downstream of the predetermined seam being formed first, and then the remaining seams being formed after the run has been advanced to move said predetermined seam from the separator.

The bond interrupting means or separator preferably comprises a fixed support disposed between the runs so as to locate a planar heat resistance member in a position in which it extends into each half of said tube.

The members preferably each include an array of heating elements, and one element of each array is preferably easily positionally adjustable so that the position of a seam made by said adjustable elements can be varied relative to said predetermined seam, for making a preferred form of the bag wherein the volume of said pocket is restricted by a seam separating a usable portion of the pocket from a closed and unfillable portion.

According to another aspect of the present invention there is provided apparatus for use in making bags which comprise a sealed compartment made of relatively robust film material and a pocket made of relatively frangible film material secured in position within the compartment and having an open mouth leading only into the pocket. The apparatus comprises feeding means, bonding means and filler means. The feeding means is arranged to feed a plurality of webs of film material including both robust and frangible material along a transit path through the bonding means. The bonding means is arranged to form bonded seams between the webs of film material to form the bags. Each bag so formed has a sealed compartment formed from the robust material, a pocket formed from the frangible material and a frangible barrier forming part of the pocket between the pocket and the compartment. Bond interrupting means is provided in the transit path to prevent bonds being made between the webs of frangible material at the mouth of the pocket. The filler means is arranged to insert a desired amount of a material into the compartment before sealing of the compartment.

The bonding means may comprise sets of cooperating rotary members or cooperating reciprocating bonding members.

The bond interrupting means may comprise a non-seal forming, or seal preventing plate insert, gap or the like disposed or interposed between seal forming portions of one or more of the bonding means.

The bag so formed may be used for mixing, as described above, e.g. by placing in the compartment, by feeding water into the pocket at the appropriate time and then rupturing the frangible barrier. Alternatively the compartment may be filled with liquid e.g. a drink and when it is desired to consume the liquid, a straw or the like may be passed down through the mouth of the bag and through the barrier into the liquid.

BRIEF DESCRIPTION OF DRAWINGS

The invention will now be described further, by way of example, with reference to the accompanying diagrammatic drawings, wherein.

DETAILED DESCRIPTION

Figure 1:
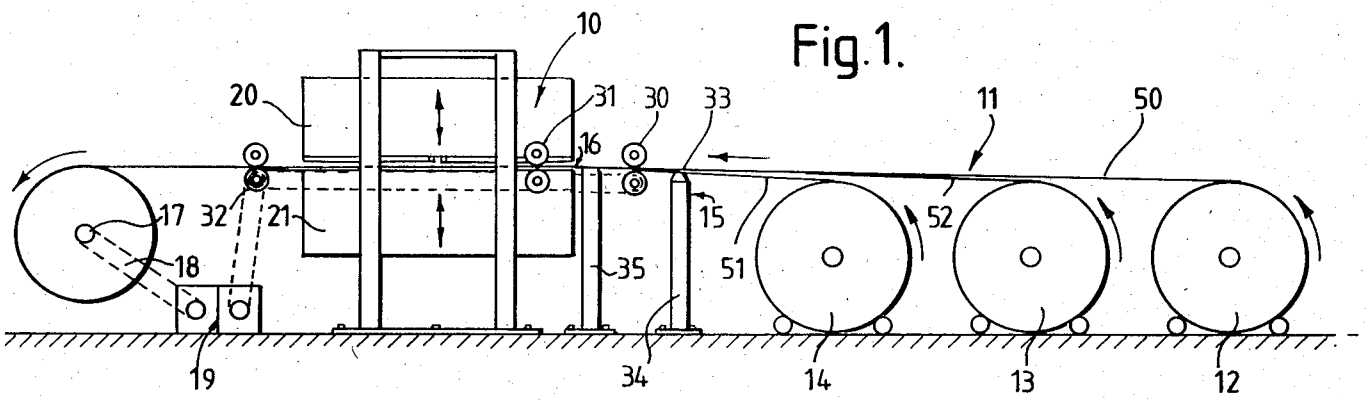
FIG. 1 shows a schematic layout of apparatus according to the invention.

All embodiments of the apparatus comprise bonding means, feed means and filler means.

The apparatus comprises web bonding means 10, feeding means 11 to feed films of waterproof thermoplastics material from rolls 12, 13 and 14 to the bonding means, via web splitting means 15 and bond interrupting means in the form of a separator 16, and take up means 17 to wind bags onto rolls 18.

The bonding means 10 comprises upper and lower relatively movable members 20 and 21, which members are mounted respectively above and below a web transit path therebetween, and which members incorporate perforators 22 and sets of heating elements, which sets confront each other across the web transit path. At least one of said members 20, 21 is movably mounted so that the sets can be moved together and apart to vary the spacing therebetween and thus to vary the thickness of the web transit path.

The feeding means 11 includes first, second and third pairs of driven or nip rollers 30, 31 and 32 to draw the films along the web transit path, and drive means 19 to drive said rollers in unison and to rotate the rolls 12, 13, 14 and 18.

The web splitting means 15 comprises a fixed knife 33 which is mounted on a support 34 so as to bisect the films longitudinally into webs as the film material is fed to the knife, and a further support 35 carries a crosspiece 36 to which the separator 16 is attached. The latter is a strip of plastics material, such as P.T.F.E., having a relatively high melting point, or is of thin metal.

Figure 5:
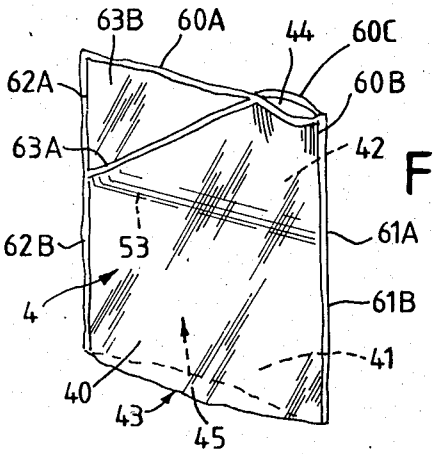
FIG. 5 is a perspective view of a bag formed by the apparatus.
Figure 4:
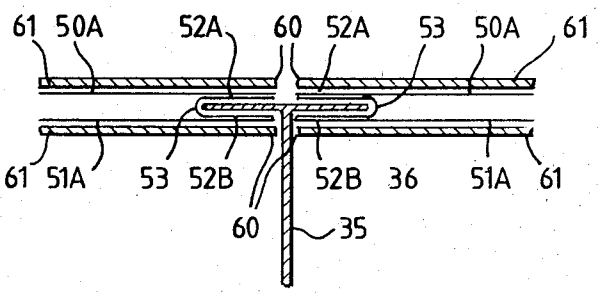
FIGS. 2, 3 and 4 are part sectional views showing portions of the apparatus respectively in plan, side and front elevation.

Referring to FIG. 5, the bag 4 formed by the apparatus comprises two outer walls 40 and 41 and an internal pocket 42. The bottom 43 of the bag is left open and a mouth 44, which opens into the pocket 42, is left open at the top of the bag.

The bags are formed from an upper film 50 and a lower film 51 of a relatively robust sheet plastics drawn from the rolls 12 and 14, and an intermediate lay-flat tube 52 of a relatively frangible plastics film material drawn from the roll 13. The films 50, 51 with the flat tube 52 sandwiched therebetween are drawn by the rollers 30 to the knife 33 so that the sandwich is split longitudinally into two symmetrical runs of webs.

Figure 2:
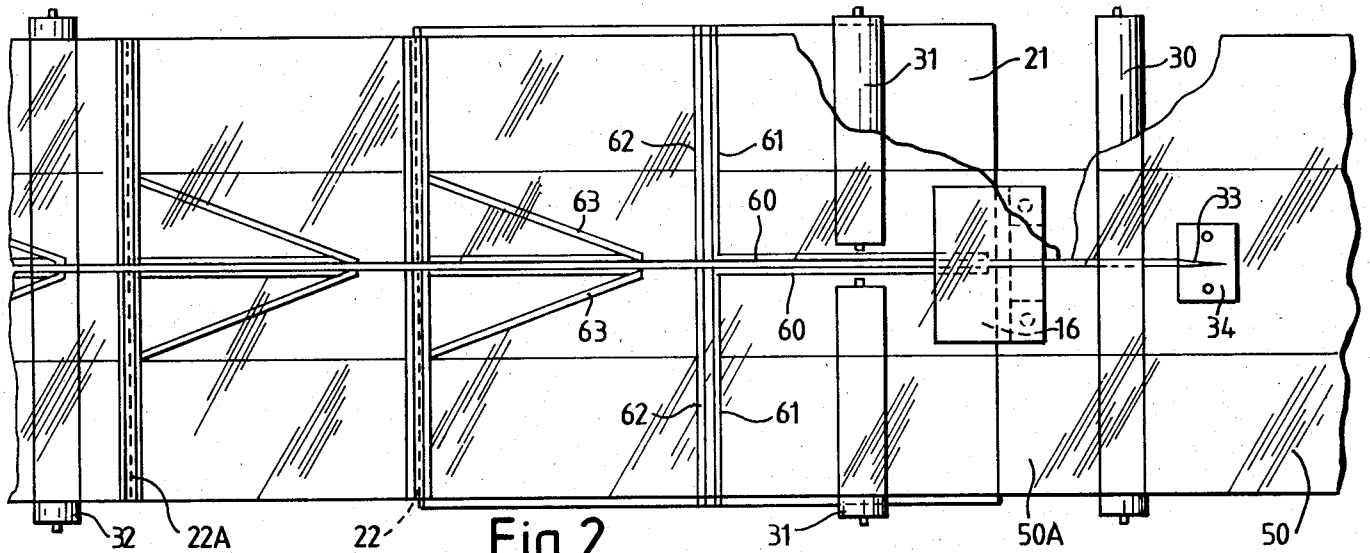
Figure 3:
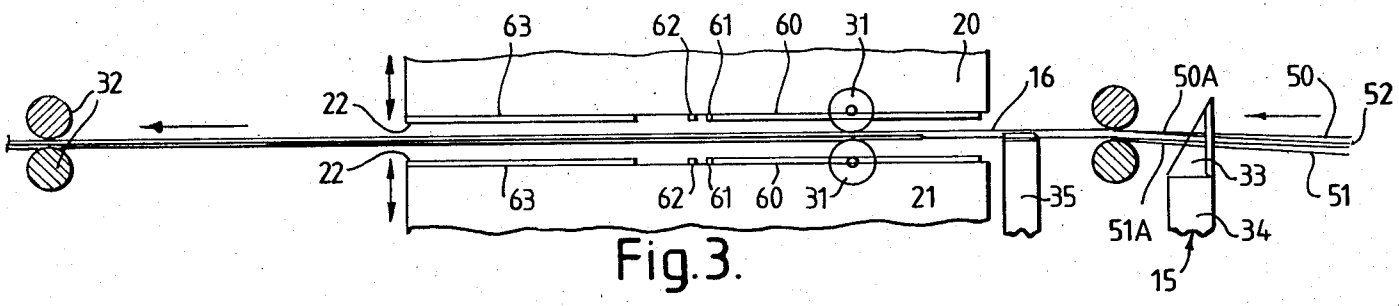

In each run there is an upper web 50A and a lower web 51A with one half of the tube 52 therebetween. Said half of the tube provides a single membrane folded to provide an upper intermediate web 52A and a lower intermediate web 52B each of lesser width than the webs 50A and 51A, and provides a junction fold 53 between said webs 52A and B, which fold 53 provides bottoms for the pockets 42. Said webs 50A, 51A, 52A and 52B abut to form a sandwich, and are drawn by the rollers 31 across the separator 16 so that the latter separates the webs 52A and B as they enter the bonding means. As shown in FIGS. 2 and 3, the separator 16 extends into the web transit path between the members 20 and 21 so as to hold apart portions of the webs 52A and B as said webs enter the path between said members.

Each set of elements comprises two similar arrays which are symmetrical about a longitudinal centre line of the web transit path, which longitudinal centre line is disposed between the two runs, the latter being guided by the rollers 31 and 32 so that the edges of the webs formed by the knife are parallel to said longitudinal centre line.

Each array confronts a complementary array on the other member to form a pair, and comprises a first element 60 parallel to the centre line, closely parallel second and third elements 61 and 62 perpendicular to the centre line, and a fourth element 63.

In each pair of arrays the first elements 60 cooperate to form a top seam of the bag, which top seam comprises a first portion 60A which joins all four webs together and two portions 60B and 60C which, during formation, are separated by the separator 16, so that the portion 60B joins the top web 50A to the webs 52A, and the portion 60C joins the bottom web 51A to the web 52B. The second elements 61 cooperate to form a first side seam of the bag which side seam comprises first portion 62A which extends from the top seam to the junction 53 to join together all four webs, and a second portion 62B which extends from the junction 53 to the bottom of the bag.

The drive means is arranged to drive the webs incrementally in steps of substantially one bag width, so that the top 60A and first side seams 62A 62B are formed first for each bag by feeding the webs between the said members, closing the members together to nip the webs between heating the elements, and, when the elements have cooled to allow the seams to set, advancing the webs to bring the part formed bags therebetween the third and fourth elements.

The third elements 62 of each pair cooperate to form the second side seam 61A and 61B which extends from the mouth to the bottom of the bag; and the fourth elements 63 form a diagonal seam 63A which extends across a top corner portion 63B of the bag so that said portion 63B serves as a handle and is sealed from the pocket and the remainder of the interior of the bag.

The perforators 22 are disposed to make a line of perforations 22A between the second seam 62A of a finished bag and the first side seam 16A and B of the next adjacent bas as the members are closed to form the second and diagonal seams of the latter bag.

The so formed bags are connected by the perforated portions therebetween and are wound gently onto the roll 14.

Figure 6:
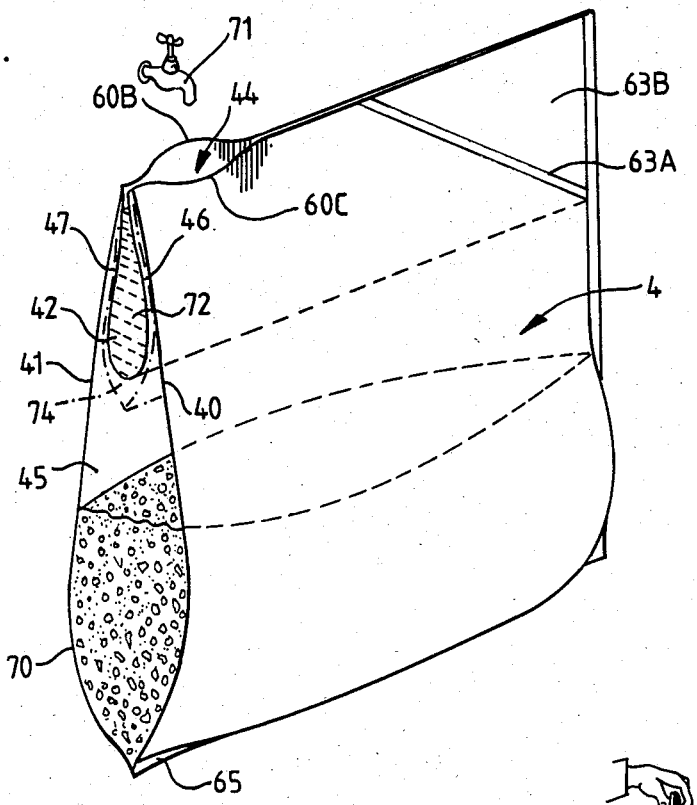
FIG. 6 is a part sectional perspective view of the bag being used as a liquid measure.

When full, the rolls 14 of bags are taken to a known form of bag filling apparatus (not shown) wherein the bags are inverted and have measured amounts of a material (70—FIGS. 6 to 8) for mixing inserted into the compartments 45 via the open bottoms 43; and thereafter the bottoms 43 are closed by a seaming device (not shown) which forms bottom seams 65 (FIGS. 6 and 8) to seal the compartments with the material 70 therein. The individual filled bags may be detached from one another and suitably packaged for the bag. to indicate a particular level to which the pocket is to The bag 4, shown in FIGS. 5 to 8 formed by apparatus according to this invention comprises the two main outer walls 40 and 41 secured together along the sides and the top of the bag as described to define a main compartment 45 therebetween; two internal webs 46 and 47 which are secured together by the means 60A, 61A, 62A and 63A. The webs 46 and 47 extend into the main compartment 45 from the top of the bag and are joined together by the fold 53 to form the pocket 42 therebetween. Along the top of the bag the wall 46 is joined to the adjacent wall 40 and similarly the wall 47 is joined to the wall 41, and the walls 46 and 47 are secured together along most but not all of the top of the bag so as to leave portions 48 defining the mouth 44 which opens into the pocket 42. The walls 46 and 47 normally lie in a flat condition in face to face abutting relationship, but the portions 48 are shown spaced apart in FIG. 6 to show the mouth 44 in an open condition ready to admit liquid to the pocket, e.g. from a tap 71. The pocket 42 serves as a measure for measuring a predetermined volume of the liquid 72 for mixing with the predetermined amount of the material 70. The diagonal seam 63A restricts the capacity of the pocket 42 so that, when filled to its restricted capacity, the pocket holds said predetermined volume. However, the seam 63A may be omitted and markings, not shown, may be printed on the bag, to indicate a particular level to which the pocket is to be filled with liquid 72, for measuring the liquid. The pocket is filled in the horizontal condition with the liquid 72, as shown in FIG. 6.

After the pocket has been filled, the mouth is closed, (e.g. by being held manually or by clamp or sealing means, or by the walls adjacent the mouth being doubled over or folded and held) and the pocket is burst or is ruptured by striking or thrusting inwards the main walls 46,47, to discharge the liquid from the pocket into the main compartment 45.

Figure 7:
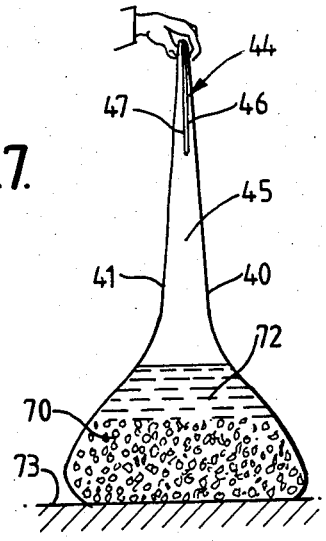
FIGS. 7 and 8 are sectional views showing the bag resting vertically and horizontally upon a surface prior to mixing of the liquid with a material contained in the bag.
Figure 8:
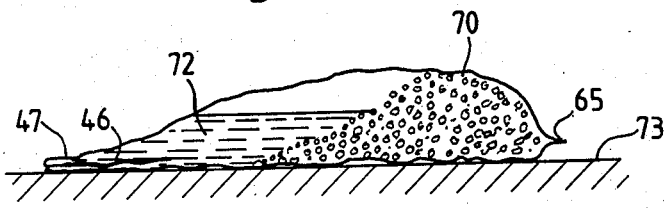

When the liquid is discharged from the pocket, the webs 46,47 assume a face to face abutting relationship and are held together by a thin film of the liquid as shown in the FIGS. 7 and 8.

In this condition the webs 46, 47 serve as a non-return valve between the main compartment and the mouth, so that the mouth can be released and the bag stood (FIG. 7) or laid on a supporting surface 73 as shown in FIG. 8, the walls 46, 47 being further held together by the bulk of material and liquid. The contents can then be mixed by manipulating the bag to form a mixture and thereafter the bag can be opened to enable the mixture to be used.

A bag described above affords several advantages including:

(a) The liquid can be inserted into the pocket at a point and time of availability of the liquid, and can be held in the bag until the mixture is required for use.

(b) Where a mixture, such as custard, has to be mixed in two stages, the pocket can be used to measure a small first quantity of liquid, which is then mixed with the material, and then the compartment can be used as a measure for a final quantity of liquid which can be inserted via the mouth and pocket into the compartment and thereafter mixed with the mixture, because air will be trapped at the top of the compartment to ensure that the walls 46, 47 abut and to leave room for mixing without overstressing the walls of the bag.

(c) The user is protected from harmful or irritating dust or fumes usually caused by mixing dry materials with liquids.

(d) The mixture can be produced (without inconvenience, spillage or the use of mixing utensils) within the bag so as to be free from contamination.

(e) The mixture is protected by the bag, e.g. to prevent evaporation of the liquid.

(f) A corner can be cut from the bag to enable the mixture to be extruded e.g. into a slot, recess or cavity to be filled.

(g) Surplus material can be left in the bag for convenient disposal.

(h) The producer of the package can fill the bag using known filling methods, but may omit the usual preliminary dry mixing or blending of the ingredients forming the material for mixing.

(i) A second material for mixing may be inserted in the pocket, e.g. a material which has to be kept apart from the material in the main compartment until the mixture is to be made, and said second material may be pre-mixed with the liquid prior to the pocket being ruptured.

The pocket is preferably made from a folded single membrane of weaker material than the main walls of the bag, so as to rupture easily, but the pocket walls may be made from individual films or webs with a frangible bond being provided between the lower margins of the pocket walls to form an easily ruptured weak seam.

The size, shape and disposition of the mouth can be varied as desired. For instance, in a vertically elongate bag, the mouth may extend substantially across the top of the bag. The mouth may be extended vertically to provide easily separable flaps or to form an inlet conduit which can be easily clamped shut or even tied in a knot to close the mouth, especially if a second material for mixing is accomodated in the pocket.

The pocket 45 may be an inner pocket located in a larger supplementary thin walled frangible pocket 74, which supplementary pocket 74 may have a side opening which is closed by a side seam after insertion of a second material for mixing.

The heating elements may be of electrical resistance or ultrasonic or high frequency welding form, and may be arranged as desired to provide bags or any suitable shape or size having open bottoms, or closed bottoms and partially open sides, for filling.

The arrays in each set, the separator, the splitter and the feeding means may be adapted to form bags of a first size or shape from one of the runs, and bags of a different size or shape from the other of the runs, subject to the limitations imposed by the need to advance the two runs of webs at a common overall rate. Alternatively a pre-arranged single run of webs may be employed and fed to bonding means comprising one pair of arrays.

Any suitable form of splitter may be employed, e.g. a moving blade, and the separator may be made of any suitable material.

The elements are detachable and may be relocated or replaced by other elements to produce other sizes and/or shapes of bags. In particular the fourth elements 63 may be easily movable or rendered inoperative to vary the position of or to omit the pocket volume limiting seams 63A.

The apparatus may include trimmers to trim or remove superfluous material from the bags.

Whilst the aforementioned apparatus described in connection with FIGS. 1 to 4 is good for making bags for subsequent filing, especially medium and large sized bags, it has a relatively slow production rate which is limited by the cycle time required for the heating and cooling of the confronting members of the bonding means.

In the first embodiment with filler means shown in FIGS. 9 and 10, the bonding means 10 comprises a first set of four rotary members 21, a second set of two rotary members 22 and a third set of two rotary members 23; together with interrupting means incorporated into the second set as hereinafter described.

The feed means 11 comprises rollers 24 and guides 25 which conduct outer webs 13, 14 and inner webs 15 and 16 from rolls 17, 18 and 19 to the bonding means 10. The outer webs 13, 14 are of a relatively strong sheet of thermoplastics material, whereas the inner webs 15 and 16 are constituted by a single longitudinally folded strip of a weaker sheet thermoplastics material, the webs 15 and 16 being joined by a longitudinal fold 20.

The guides 25 serve to separate the webs 15 and 16 prior to these webs reaching the first set of members 21. The members 21 are electrically heated heat sealing rollers arranged in two pairs, each pair defining a nip between which longitudinal margins of the webs are fed, so that one pair produces a continuous seam 26 between the webs 13 and 15, and the outer pair produces a continuous seam 27 between the webs 14 and 16, as shown in FIG. 10.

Further rollers 28 serve to bring all marginal portions of the webs 13 to 16 together ahead of the second set. Each member 22 of the second set comprises first and second arcuate peripheral electrically heated heat sealing portions 31 and 32 linked by a linear peripheral heat sealing portion 33, and a circular peripheral heat sealing portion 34 remote from the portions 31 and 32. The first and second portions 31 and 32 are interrupted by respective gaps 35, 36 (FIG. 9) or unheated peripheral portions 37, 38 (FIG. 10) which constitute the interrupting means.

The portions 31 together form a seam 39 and the portions 32 form a parallel seam 40 of equal length, and a short transverse seam 41 is formed by the portions 33 to join the ends of the seams 39 and 40 alongside a mouth part 42 of each bag. The seams 39, 40 and 41 connect all four webs together. Similarly, the portions 34 produce a continuous longitudinal seam 43 joining the marginal other portions of the outer webs 13 and 14.

The rotary members 23 each have a double seaming and severing linear peripheral part 44 which produces two parallel transverse seams 45 and 46 and severs the seamed together webs between these seams 45 and 46, so that the just formed seam 45 remains on the bag being formed whilst the seam 46 closes the last formed bag.

The seam 45 joins the other ends of the seams 39 and 40, so that the area of the bag defined between the seams 39, 40 41 and 45 serves as a handle or holdable portion of the bag; and the seam 46 serves to connect the webs together at the end of the mouth part 42 remote from the seam 41.

The filler means 12 may compromise a duct 47 which directs material 48 for mixing to between the outer webs 13 and 14 so that the material comes to rest on the seam 45 of the bag being formed.

The finished bag is similar to that described above see FIGS. 5 to 8, and has an open mouth 49 leading into a measuring pocket bounded by the webs 15 and 16, leaving a sealed compartment in which the material 48 is disposed.

The second embodiment with filler means employs many parts identical with parts of the first embodiment with filler means which parts are indicated by the same reference numerals and are not described further, and modified parts are indicated by the addition of the suffix A. In this embodiment the first set of rotary members 21 is omitted, and the bonding means 10 employs an alternative interrupting means 50, and modified first and second portions 31A and 32A. These modified portions 31A and 32A are circular and are capable of producing continuous longitudinal seams.

Figure 12:
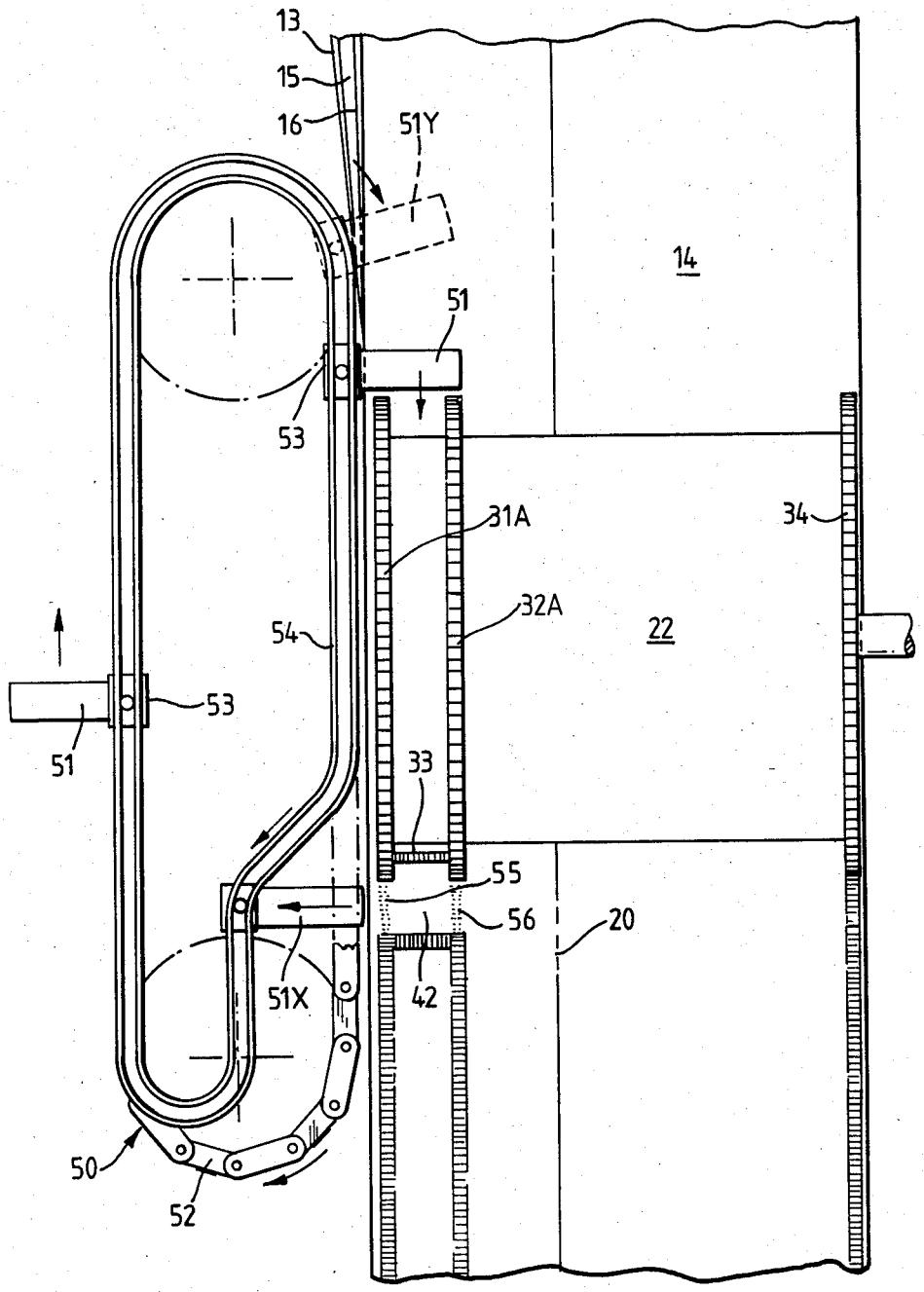
FIG. 12 shows an enlarged view of part of the apparatus shown in FIG. 11.
Figure 13:
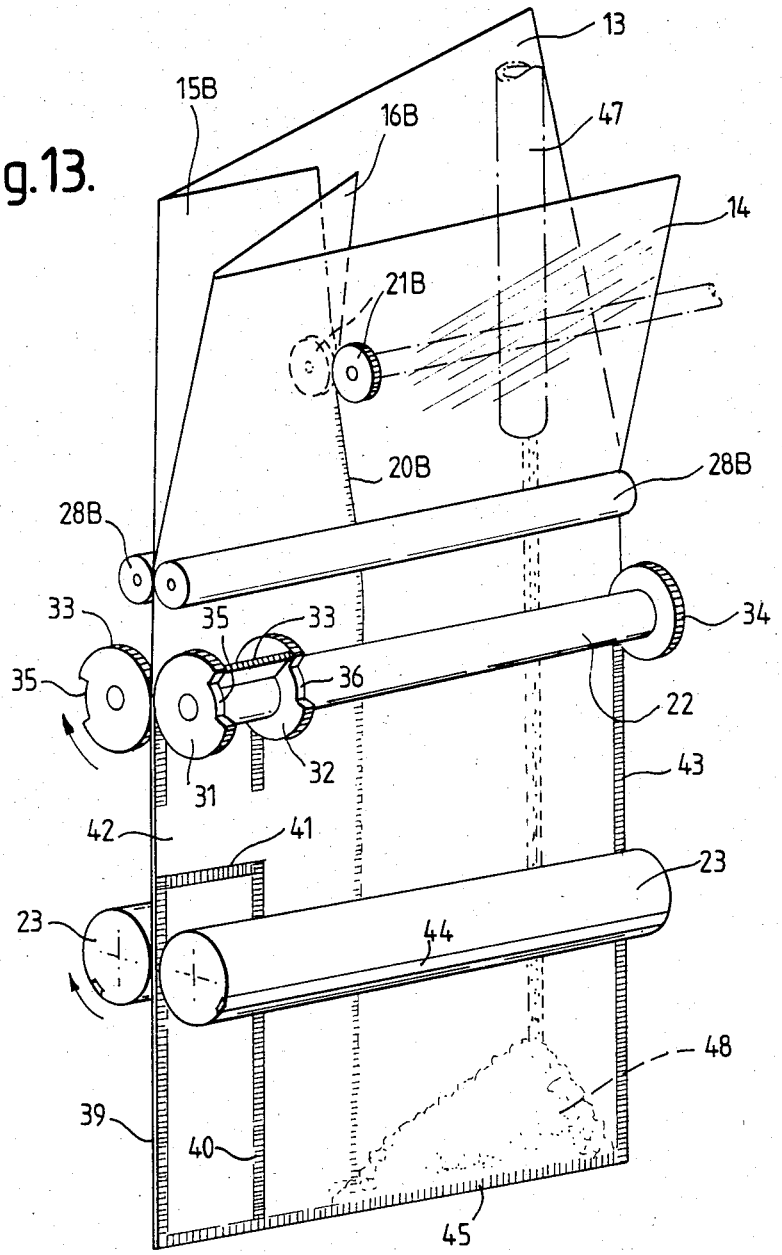
FIG. 13 shows parts of a third embodiment of apparatus of the invention including filler means.

The interrupting means 50 (FIG. 12) comprises blades 51, of a material which is resistant to bonding to thermoplastics materials, mounted on a belt or chain 52 of a rotary support mechanism by means of carriers 53 which engage guide means 54 to move the blades from a retracted condition, e.g. the blade 51X, to a projecting condition, e.g. the blade 51Y as the blades 51 are carried round a predetermined path by the belt or chain. The belt or chain is driven in unison with the sets of rotary members so that each blade is inserted between the inner webs 15 and 16 and moves therewith to between the portions 31A and 32A to prevent seams being formed between the mouth portions of these webs 15 and 16 whilst permitting seams 55 and 56 being formed between these mouth portions and the abutting mouth portions of the outer webs 13 and 14, thereafter, the blade 51 is retracted from the mouth prior to the seam 46 being made alongside the mouth. Except for the extra seams 56, the bag is the same as that made by the apparatus of FIGS. 9 and 10.

The third embodiment of apparatus with filler means again employs many of the parts of the first embodiment with filler means which parts are either omitted or indicated by the same reference numerals, together with some modified parts indicated by the addition of the suffix B. This embodiment is adapted to make a bag from two strips of sheet material, in which each sheet is folded to provide an outer web 13B or 14B and an inner web 15B or 16B.

Figure 9:
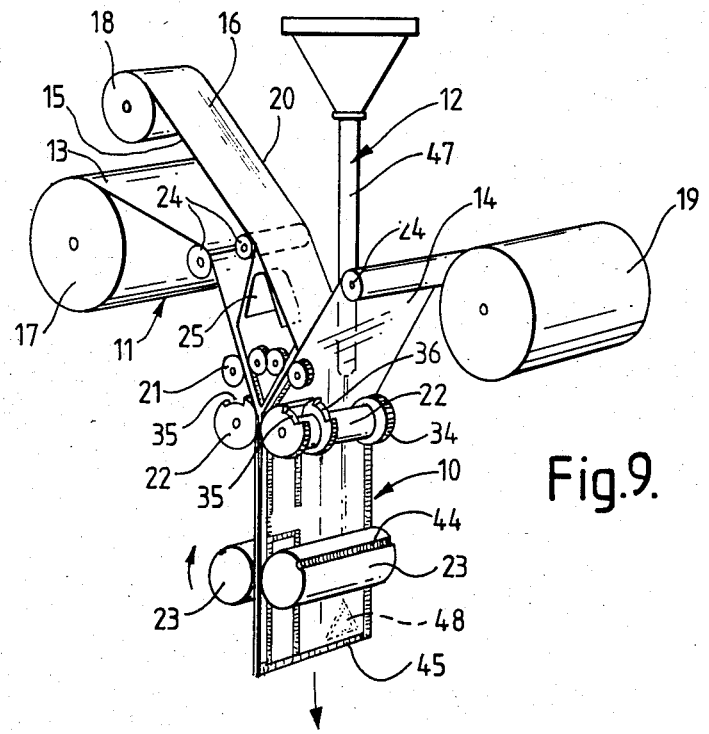
FIG. 9 shows a first embodiment of apparatus of the invention which includes filler means.
Figure 10:
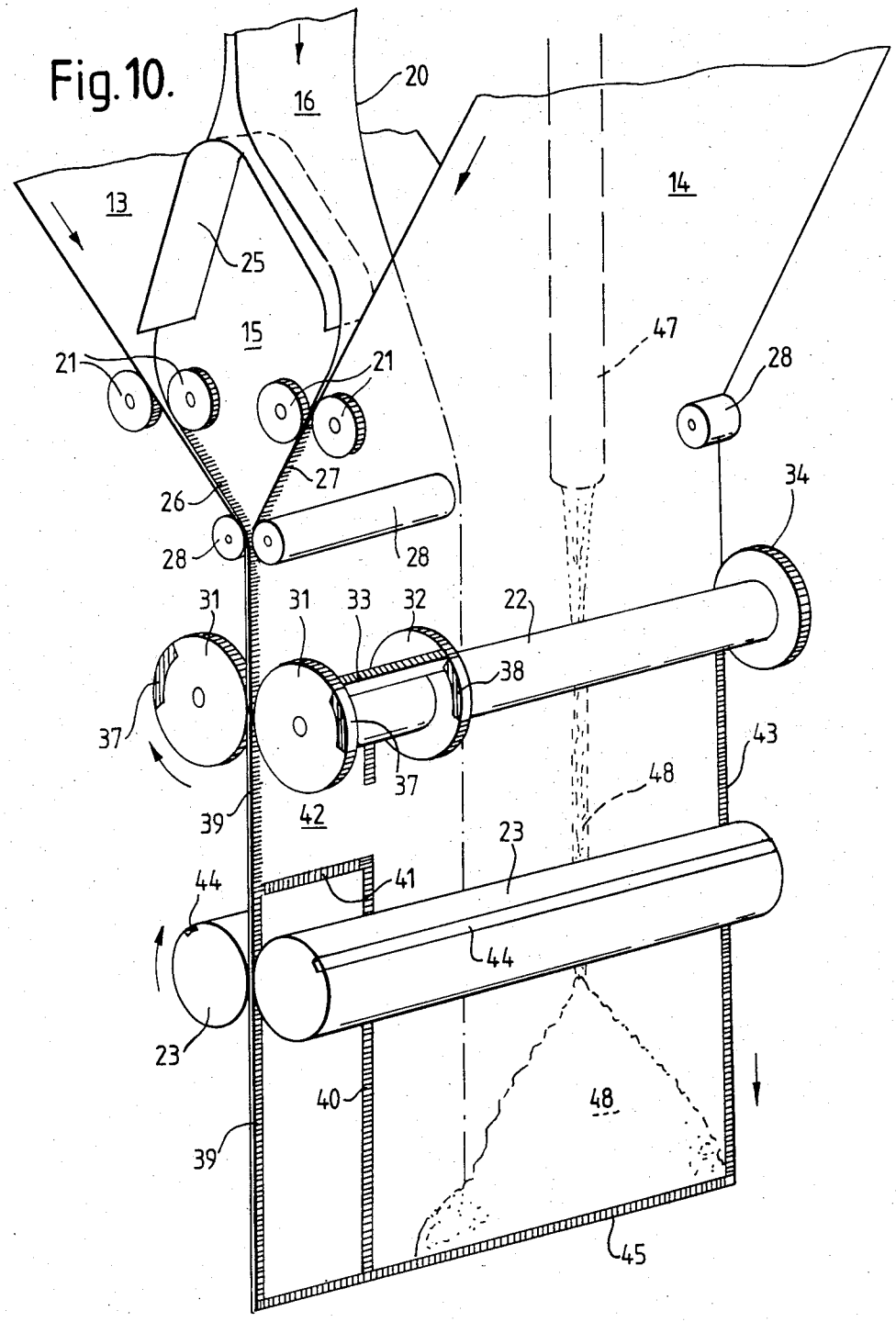
FIG. 10 is an enlarged view of part of the apparatus shown in FIG. 9.

The first set comprises only two members 21B which are arranged to form a continuous frangible or weak seam 20B or a seam 20B having weak or frangible portions, between the inner marginal portions of the webs 15B and 16B, at the same position as the fold 20 in FIG. 9. The bags so formed are functionally equivalent to the bags made by the apparatus of FIG. 9, except in that the seam 20B is frangible instead of the webs 15 and 16 being frangible.

Instead of prefolding the strips of sheet material, two unfolded sheets may be seemed together by one pair of members 21 or 21B and then the joined sheets may be folded to form the webs 13, 14, 15B and 16B prior to the webs reaching the rollers 28B.

The foregoing forms of apparatus are arranged to form the bags as described above, but may be adapted to produce simpler smaller bags for "shake-mix" materials which, when mixed with approximately the correct amount of liquid, produce a fluent liquid product e.g. a drink. The fourth embodiment of apparatus with filler means is adapted to produce such simple bags from the webs 13 and 14 which bags are not particularly suitable for mixing viscous or semi-liquid products or products which require vigorous, prolonged mixing or transport or storage after mixing, because they lack the self-closing automatic non-return valve function of the webs 15,16 or 15B, 16B inherent in the previously described embodiment.

Figure 14:
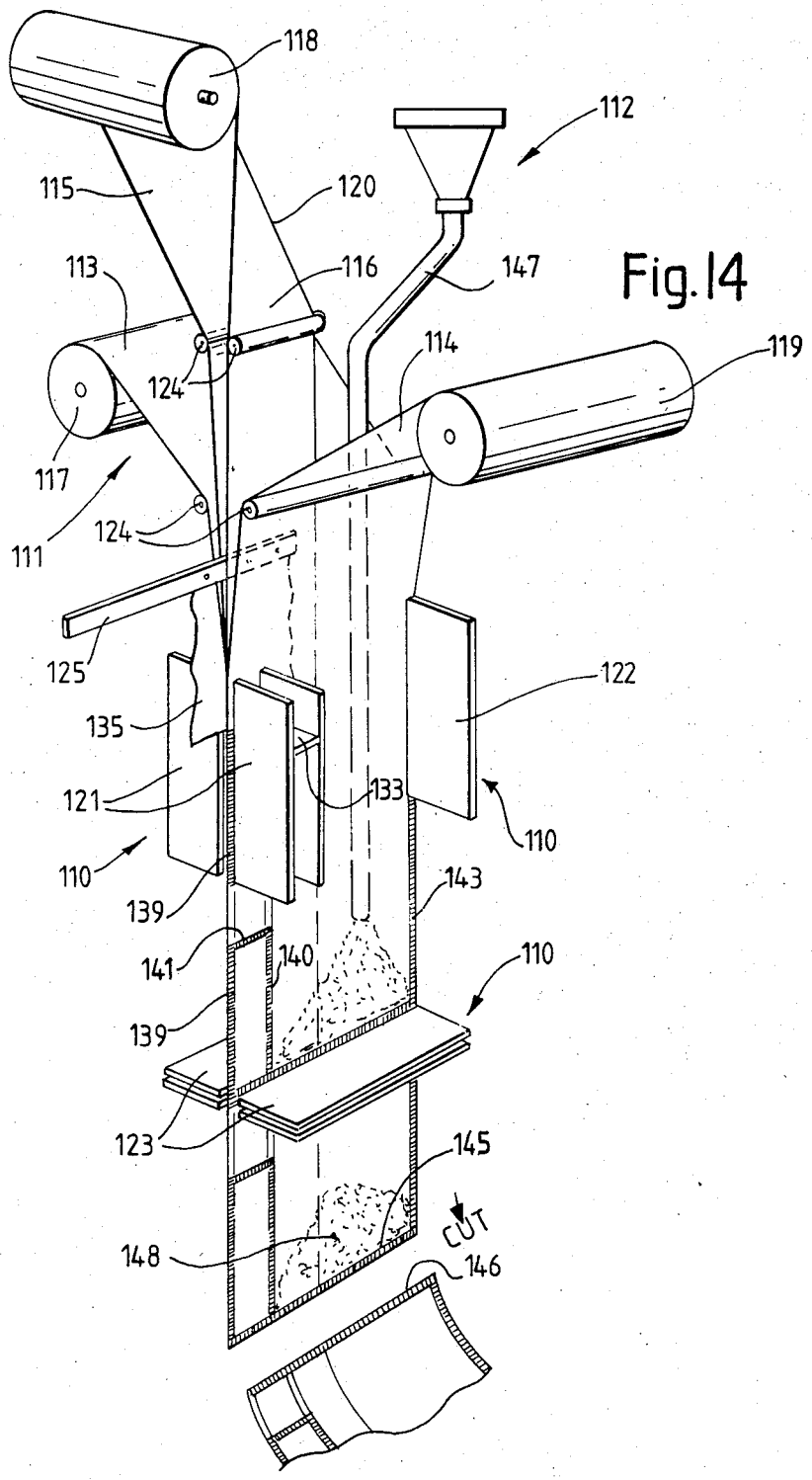
FIG. 14 shows a fourth embodiment of apparatus of the invention including filler means.

In the first three embodiments of the invention with filler means the various means have been formed by rotary bonding means but in the embodiment shown in FIG. 14 the bonding means comprises cooperating reciprocating bonding members. Therefor, the references used in FIG. 14 are in one hundred series but, where possible, their numbers correspond to equivalent numbering in the earlier embodiments.

In the embodiments shown in FIG. 14, the bonding means 110 comprises a first set of reciprocable bonding or sealing members 121 and a second set of reciprocable bonding or sealing members 122 and a third set of reciprocable members 123 together with interrupting means as hereinafter described.

The feed means 111 comprises rollers 124 and guides 125 which conduct outer webs 113, 114 and inner webs 115 and 116 from rolls 116, 118 and 119 to the bonding means 110. The outer webs 113, 114 are relatively strong sheet thermoplastics material, whereas the inner webs 115 and 116 are constituted by a single longitudinally folded strip of a weaker sheet thermoplastics meterial, the webs 115 and 116 being joined by a longitudinal fold 120.

The guides 125 serve to separate the webs 115 and 116 prior to these webs reaching the first set of bonding members 121. The members 121 may be electrically heated heat sealing plate members arranged in pairs defining a nip between the members into which longitudinal margins of the webs are fed to produce a continuous seam 139 between the webs 113 and 115, which forms the top seam of the bag leaving the mouth unsealed due to the presence of interrupting means 135. At the same time sealing or bonding members 121 form seams 140 and 141 and bonding members 122 form seam 143.

The outer members 121 therefore together form the seam 139 and the inner members 121 form the parallel seam 140 preferably of slightly longer length, and a short transverse seam 141 is formed by the portions 133 to join the ends of the seams 139 and 140 alongside a throat part 142 of each bag. The seams 139, 140 and 141 connect all four webs together. Similarly, the members 122 produce a continuous longitudinal seam 143 joining the marginal outer portions of the outer webs 113 and 114 to form the bottom of the bag.

The bonding members 123 each have a double seaming and severing function which produces two parallel transverse seams 145 and 146 and severs the seamed together webs between these seams 145 and 146, so that the just formed seam 145 remains on the bag being formed whilst the seam 146 closes the last formed bag.

The seam 145 joins the ends of the seams 139 and 140, remote from the mouth, so that the area of the bag defined between the seams 139, 140, 141 and 145 serves as a handle or holdable portion of the bag; and the seam 146 serves to connect the webs together at the end of the throat part 142 remote from the seam 141.

The filler means 112 may be of known form comprising a duct 147 which directs material 148 between the outer webs 113 and 114 so that the material during manufacture of the bag comes to rest on the seam 145 of the bag being formed.

As with earlier embodiments the finished bag is similar to that described above and has an open mouth leading into a pocket bounded by the webs 115 and 116, leaving a sealed compartment in which the material is disposed.

Alternatively, the bonding means may be flexibly mounted to allow the bonding means limited movement with the webs so that sealing can be effected while the webs are moving through the machine, spring means or the like being provided to return the bonding means to their original position. In another embodiment not shown the bonding means may be mounted for movement around a track in a manner similar to the mounting of the interruption means 51 in FIG. 5.

So that the bonding means are reciprocated inwardly towards the webs to form a nip to effect bonding and move with the webs during bondings. Therefore, a machine in accordance with the invention may be provided with any form of bonding means or suitable combination thereof. As one further example. the longitudinal bonding means could be rotary and the transverse bonding and cutting means could conveniently be reciprocable.

Figure 15:
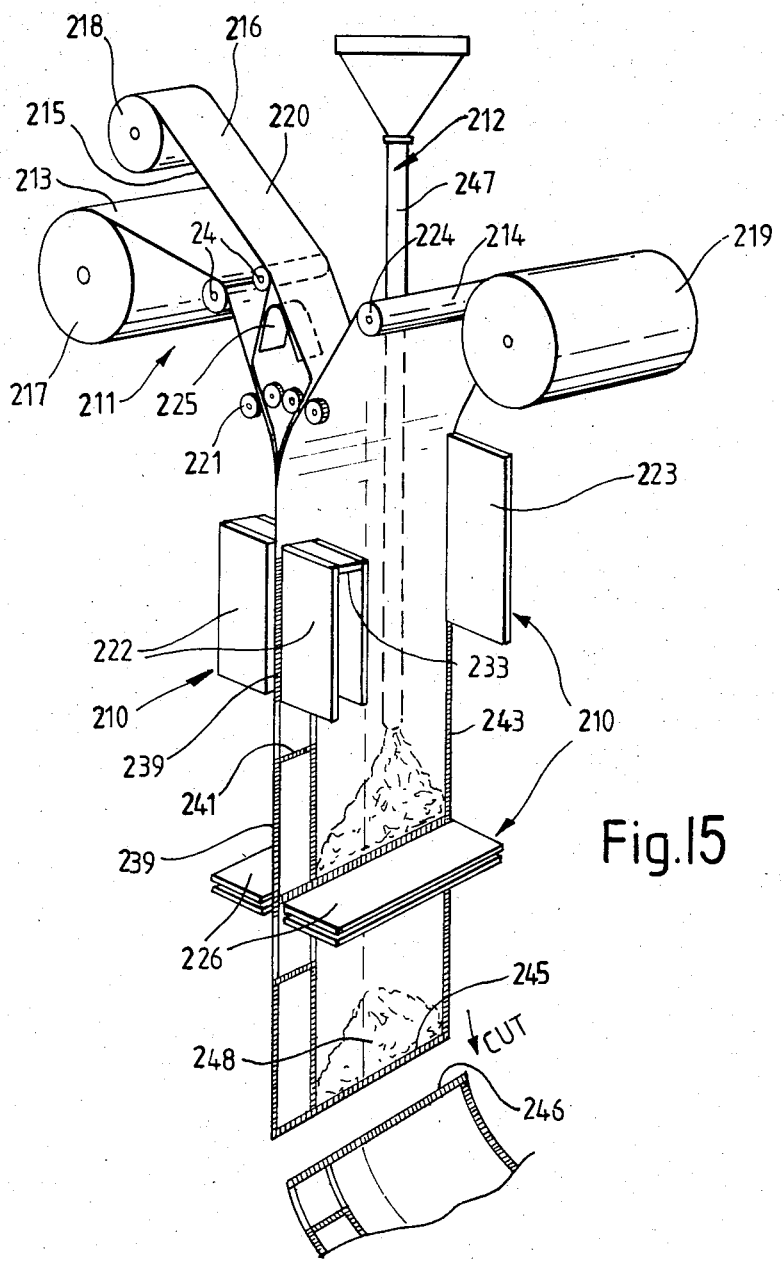
FIG. 15 shows a fifth embodiment of apparatus of the invention including filler means.

Another example is illustrated in the embodiment shown in FIG. 15 in which the bonding means 210 comprises a first set of four rotary members 221, a second set of reciprocating members 222, a third set of reciprocating members 223 and a fourth set of reciprocating members 226.

The feed means 211 comprises rollers 224 and guides 225 which conduct outer webs 213, 214 and inner webs 215 and 216 from rolls 217, 218 and 219 to the bonding means 210. The outer webs 213, 214 are of a relatively strong sheet thermoplastics material, whereas the inner webs 215 and 216 are constituted by a single longitudinally folded strip of a weaker sheet thermoplastics material, the webs 215 and 216 being joined by a longitudinal fold 220.

The guides 225 serve to separate the webs 215 and 216 prior to these webs reaching the first set of members 221. The members 221 are electrically heated heat sealing rollers arranged in two pairs, each pair defining a nip between which longitudinal margins of the webs are fed, so that one pair produces a continuous seam between the webs 213 and 215, and the other pair produces a continuous seam between the webs 214 and 216.

The marginal portions of the webs 213 to 216 are then brought together at the second set of reciprocable bonding or sealing members 222 and the third set of reciprocable bonding or sealing members 223 are shorter in longitudinal length than the members 223 set of reciprocable members 222 so as to form the interruption necessary for the mouth opening of the bag as will be explained. The fourth set of reciprocable members 226 for the transverse seam as in the embodiment of FIG. 15.

The members 222, may be electrically heated heat sealing plate members arranged in pairs defining a nip between the members into which longitudinal margins of the webs are fed to produce a continuous seam 239 between the webs 213 and 215, which forms the top seam of a bag leaving the mouth 249 unsealed due to the interruption caused by the relative length of the plate members 222. At the same time sealing or bonding members 222 form seams 240 and 241 and bonding members 223 form seam 243.

The outer members 222 therefore together form the seam 239 and the inner members 222 form the parallel seam 240 preferably of slightly longer length, and a short transverse seam 241 is formed by the portions 233 to join the ends of the seams 239 and 240 alongside a throat part of each bag. The seams 239, 240 and 241 connect all four webs together. Similarly, the members 223 produce a continuous longitudinal seam 243 joining the marginal outer potions of the outer webs 213 and 244 to form the bottom of the bag.

The bonding members 226 each have a double seaming and severing function which produces two parallel transverse seams 245 and 246 and severs the seamed together webs between these seams 245 and 246, so that the just formed seam 245 remains on the bag being formed whilst the seam 246 closes the last formed bag.

The seam 245 joins the ends of the seams 239 and 240, remote from the mouth, so that the area of the bag defined between the seams 239, 240, 241 and 245 serves as a handle or holdable portion of the bag; and the seam 246 serves to connect the webs together at the end of the throat part 242 remote from the seam 241.

The filler means 212 may comprise a duct 247 which directs material 248 between the outer webs 213 and 214 so that the material during manufacture of the bag comes to rest on the seam 245 of the bag being formed.

Figure 16:
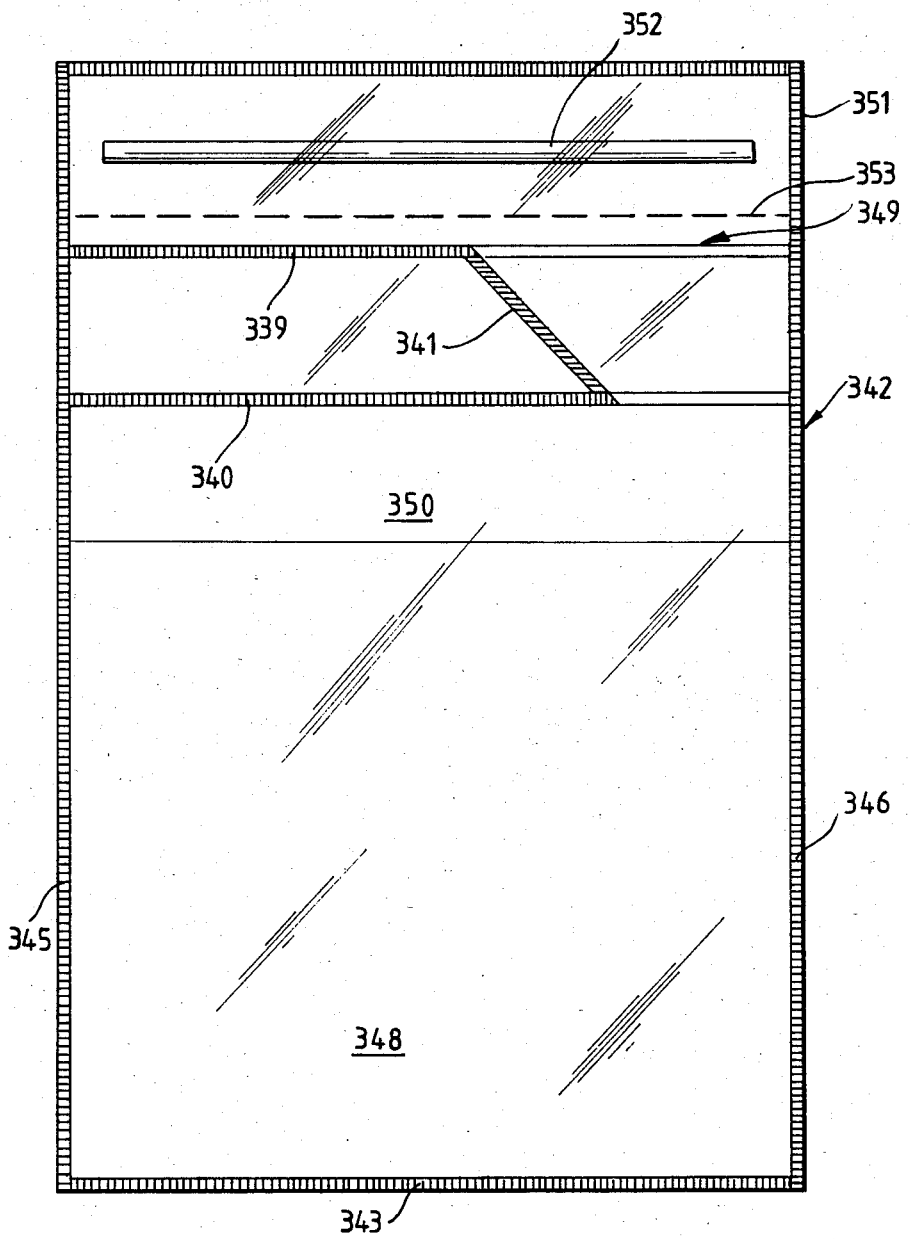
FIG. 16 is an enlarged view of an alternative bag.

FIG. 16 shows an example of a simple form of bag that can be made by apparatus according to the invention.

The bag has a sealed compartment 348, a pocket 350, bounded by the inner webs the same as webs 115, 116, and a mouth 349 leading to the pocket. However, in addition the bag includes a top section 351 in which is received a straw or tubular power or dispenser 352. The top section 351 allows the bag to be completely sealed about its periphery and then the bag may be opened by tearing away the top section 351 along the line of perforations 353. The straw 352 may then be removed, inserted into the mouth 349 and used to rupture the barrier between the pocket 350 and the compartment 348. Thus the sealed compartment 348 may include a liquid drink ready for consumption either by sucking through the straw 352 or by using the straw 352 as a power. Alternatively the sealed compartment may include milk shake powder or orange drink crystals or the like in which case the pocket 350 may be used as a measure.

Figure 11:
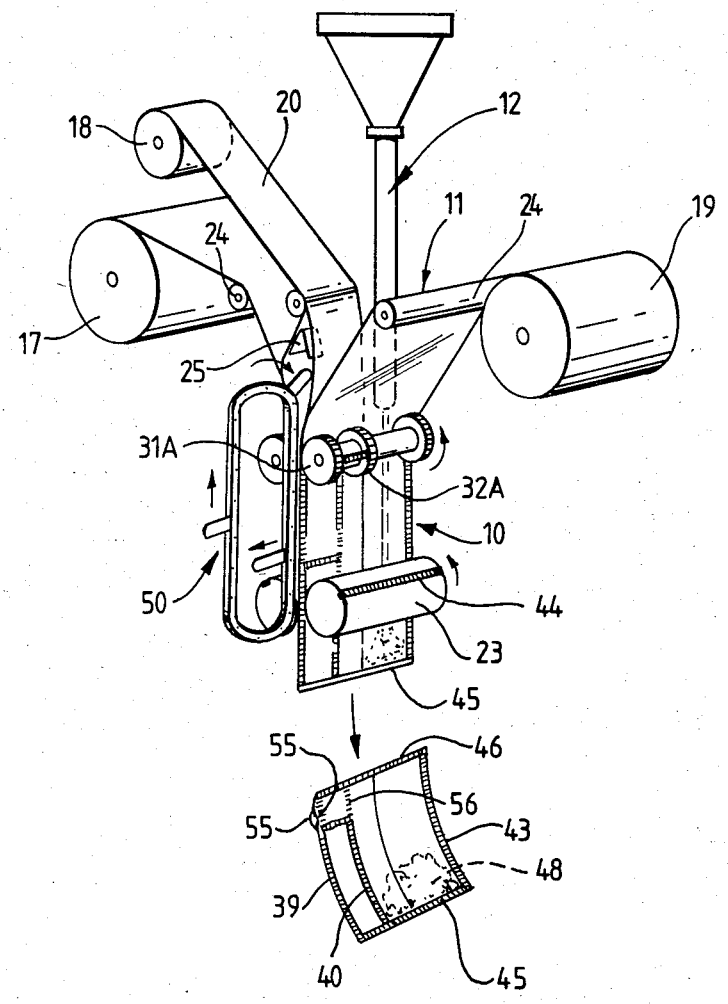
FIG. 11 shows a second embodiment of apparatus of the invention including filler means.

The bag, particularly in larger sizes, may be used for the packaging of dry powders such as coffee granules and washing powder where the mouth 349 serves as a guide for a dispenser provided as in FIG. 11 or provided separately. In such a case the pocket 350 provides a hermetic seal before use and, after rupture of the pocket, provides a one way valve as with liquid.

I claim:

1. Apparatus for use in making bags which comprise a sealed compartment made of relatively robust film material and a pocket made of relatively frangible film material secured in position within the compartment, and provided with an open mouth leading only into the pocket wherein the apparatus comprises:

(a) feeding means and bonding means, (b) the feeding means arranged to feed a plurality of webs of the film material including both robust and frangible material along a transit path through the bonding means including confronting bonding members disposed at opposite sides of the web transit path, (c) said bonding members being arranged to form bonded seams between the webs of film material to form the bags, (d) bond interrupting means located in the web transit path between at least portions of two of the said confronting members of the bonding means to prevent bonds being made to those surfaces of said webs of frangible material which abut the bond interrupting means so as to form the mouth of the pocket while allowing bonds to be made to the other surfaces of the said webs at each side of the bond interrupting means to complete the bag.

2. Apparatus according to claim 1 wherein the bonding means form the bags in at least two stages, some of the bonded seams lying in the direction of movement of the webs and other seams lying transversely to said direction of movement.

3. Apparatus according to claim 2 wherein the bond interrupting means is operable during the first stage of bonding.

4. Apparatus according to claim 1 wherein the bonding means include arrays of heating elements, one element of each array being easily positionally adjustable so that the position of the bonded seam made by an adjustable element can be varied.

5. Apparatus according to claim 1 wherein the bond interrupting means is in the form of a static web separator adapted to seat between adjacent webs of the frangible material to prevent bonding and so form a mouth for the pocket.

6. Apparatus according to claim 5 wherein the separator comprises a fixed support including a heat resistant planar member and the frangible web drawn from the feeding means is tubular, cutting means being provided to divide the tube longitudinally into tube halves so that the planar member can be inserted into the tube so as to extend into each half of the tube.

7. Apparatus for use in making bags which comprise a sealed compartment made of relatively robust film material and a pocket made of relatively frangible film material secured in position within the compartment and provided with an open mouth leading only into the pocket wherein the apparatus comprises:

(a) feeding means, bonding means and filler means, (b) the feeding means being arranged to feed a plurality of webs of film material including both robust and frangible material along a transit path through the bonding means, (c) the bonding means being arranged to form bonded seams between the webs of film material to form the bags, (d) each bag so formed having a sealed compartment formed from the robust material, a pocket formed from the frangible material and a frangible barrier forming part of the pocket between the pocket and the compartment, and (e) bond interrupting means located in the transit path to prevent bonds being made between the webs of frangible material at the mouth of the pocket, (f) the filler means being arranged to insert a desired amount of a material into the compartment before sealing of the compartment.

8. A bag making apparatus according to claim 7 wherein the bonding means comprises sets of cooperating rotary members.

9. A bag making apparatus according to claim 7 wherein the bonding means comprises sets of cooperating reciprocating members.

10. A bag making apparatus according to claim 8 wherein the cooperating rotary members have seal-forming peripheral portions, and the bond interrupting means is in the form of a non-seal forming peripheral portion.

11. A bag making apparatus according to claim 8 wherein the cooperating rotary members have seal forming peripheral portions, and the bond interrupting means is in the form of a non-seal forming insert or a non-seal forming gap preventing the formation of seams between those portions of the surface of the webs which define the mouth of each pocket.

12. A bag making apparatus according to claim 7 wherein the feeding means is adapted to feed two outer webs of the relatively robust film material and two inner webs of the relatively frangible film material to said bonding means, and the bonding means is arranged so that the inner webs are united to define the pocket and the outer webs and the inner webs are united to form the compartment.

13. Apparatus for use in making bags which comprise a sealed compartment made of relatively robust film material and a pocket made of relatively frangible film material secured in position within the compartment and having an open mouth leading only into the pocket wherein the apparatus comprises:

(a) feeding means and bonding means, (b) the feeding means being arranged to feed a plurality of webs of the film material including both robust and frangible material along a transit path through the bonding means which comprise sets of cooperating rotary members for making bonded seams between the moving webs of material, (d) said sets including a first set for making seams longitudinally of the webs and a second set for making seams transversely of the webs, (d) the bonding means including bond interrupting means arranged to prevent bonds being made between the webs of frangible material at the mouth of the pocket, (e) whereby the sets of rotary members and the interrupting means cooperate to form bags from the webs, each bag comprising a filled and sealed or sealable compartment, a pocket and a frangible barrier between the compartment and the pocket.

14. Apparatus for use in making bags which comprise a sealed compartment made of relatively robust film material and a pocket made of relatively frangible film material secured in position within the compartment and having an open mouth leading only into the pocket wherein the apparatus comprises:

(a) feeding means and bonding means, (b) the feeding means being arranged to feed a plurality of webs of the film material including both robust and frangible material along a transit path through the bonding means including sets of cooperating reciprocable members for making bonded seams between the moving webs of material, (c) said sets including a first set for making seams longitudinally of the webs and a second set for making seams transversely of the webs, (d) the bonding means including bond interrupting means arranged to prevent bonds being made between the webs of frangible material at the mouth of the pocket, (e) whereby the sets of reciprocable members and the interrupting means cooperate to form bags from the webs, each bag comprising a filled and sealed or sealable compartment, a pocket and a frangible barrier between the compartment and the pocket.

* * * * *